United States Patent [19]

Baker

[11] Patent Number: 4,651,647

[45] Date of Patent: Mar. 24, 1987

[54] ADJUSTABLE RANGE PROXIMITY FUZE

[75] Inventor: Arleigh B. Baker, Longwood, Fla.

[73] Assignee: Werkzeugmaschinenfabrik Oerlikon-Buehrle AG, Zurich, Switzerland

[21] Appl. No.: 718,419

[22] Filed: Apr. 1, 1985

[51] Int. Cl.[4] ..... F42C 13/02

[52] U.S. Cl. ..... 102/213; 102/214

[58] Field of Search ..... 102/213, 214; 343/7 PF

[56] References Cited

U.S. PATENT DOCUMENTS

| | | | |
|---|---|---|---|
| 3,844,217 | 10/1974 | Ziemba | 343/7 PF |
| 3,858,207 | 12/1974 | Macomber et al. | 102/214 |
| 3,902,172 | 8/1975 | Weiss et al. | 102/213 |
| 3,926,121 | 12/1975 | McCracken | 102/214 |
| 3,985,080 | 10/1976 | Kostecki | 102/214 |
| 4,047,122 | 9/1977 | Rao | 330/84 |
| 4,089,000 | 5/1978 | Bradford | 343/7 PF |
| 4,096,480 | 6/1978 | Miner et al. | 102/214 |
| 4,128,836 | 12/1978 | Ramos et al. | 102/214 |
| 4,135,452 | 1/1979 | Kinsey et al. | 102/214 |
| 4,140,060 | 2/1979 | Brenner | 102/214 |
| 4,332,468 | 6/1982 | Stutzle | 102/213 |
| 4,333,079 | 6/1982 | Dick et al. | 102/214 |
| 4,422,075 | 12/1983 | Nerheim | 102/214 |
| 4,497,252 | 2/1985 | Taylor | 102/213 |

*Primary Examiner*—Charles T. Jordan

*Attorney, Agent, or Firm*—Julian C. Renfro

[57] ABSTRACT

A proximity fuze of adjustable maximum range, configured to detect target pulses reflected only from a target within the lethality range of the associated warhead. My invention comprises a wideband switchable video amplifier connected to receive target pulses detected by a detector, and serving to supply therefrom an amplified version of the pulses to a pulse counter. The wideband switchable video amplifier is connected to receive signals from a gate generator, which signals do not interfere with the passage through the video amplifier of pulses representative of a target that will fall within the lethality range of the associated warhead. However, the gate generator provides blanking signals to the video amplifier that serve to prevent pulses reflected from a target outside such lethality range from reaching the pulse counter, and therefore preventing inappropriate detonation of the warhead. Quite advantageously, my novel fuze concept is usable with electro-optical devices or with radar.

22 Claims, 10 Drawing Figures

ADJUSTABLE RANGE PROXIMITY FUZE

BACKGROUND OF THE INVENTION

The present invention relates to an electro-optical fuze that features range control by time-gating rather than by target rejection based on amplitude.

In proximity fuze systems presently in use on certain guided missiles, the time delay between the detection of the target and the warhead burst is programmed as a function of relative closing velocity between the target and the missile. The purpose of the delay is to maximize the probability of the lethal portions of the warhead striking a vulnerable area of the target. If correctly determined, this delay would be a function not only of closing velocity as in present systems, but also of missile-target range at time of detection by the fuze. Since present proximity fuze systems do not determine missile-target range at intercept, the time delay between target detection and warhead burst is of necessity a compromise based only on velocity information provided in most cases by the missile guidance system.

Other inventions provide a means of determining the missile-target range at the time of intercept, permitting a more optimum control over warhead burst time to effect maximum target damage.

One of the inventions of the latter type provides a circuit arrangement which permits the use of multiple range gates and special adapted thresholds which permit sharp range definition, resulting in the determination of target range at the time of target detection. The input from a receiver consisting of a unipolar video pulse train resulting from the detection of microwave pulses reflected from a target, is applied to the inputs of three gates and an amplitude detector. The timing of the gates is such that the pulses pass through target gate one if they have been reflected from an object, the range of which is between O and R1 feet. Pulses are passed through target gate two if they have been reflected from an object, the range of which is between R1 and R2 feet. In a similar manner, pulses are passed through target gate three if they have been reflected from an object, the range of which is between R2 and R3 feet. An amplitude detector and threshold driver set the thresholds on an individual pulse basis, thereby providing sharp discrimination between ranges regardless of pulse amplitude. Thus, such earlier invention provided a means of determining the missile-to-target range at the time of intercept, to permit a more optimum control over warhead burst time to effect maximum target damage.

It was in an effort to decrease the complexity of such prior art devices that the present invention was evolved.

SUMMARY OF THE INVENTION

This invention relates to a missile proximity fuze using electro-optical detection, which is totally independent of the guidance system in measuring range-to-target. The unit includes an electro-optical transmitter which emits an infrared pulse that is reflected from the target to the receiver. The receiver includes a wide band video amplifier having a blanking control which is set prior to flight to permit the reception of target reflections only during a desired time period, and to block the reception of such signals at other times. This invention utilizes a blanking control that will operate fast enough, say within 10 nanoseconds, without causing false targets due to blanking transients. My advantageous design of a blanking control gate makes possible a relatively non-complex range gated proximity fuze.

A programmable period of the gate produces a blanking signal as a function of range. In effect, target position is determined by gating range rather than by measuring it, which of course is a much simpler operation. The timer maintains the detection system active for a sufficient period in which a reflected pulse would be received when the target is within a desired range. Thus, quite advantageously, the system is insensitive to detection of objects beyond the desired range.

It is therefore to be seen that I have provided a new version of an E/O (electro-optical) or radar fuze that features range control by time-gating rather than by amplitude discrimination which, as well known, is subject to system component variations.

Quite advantageously, the detection of objects beyond the desired range is prevented by blanking the receiver. Blanking is preferably provided by a differentially-blanked video amplifier/switch, also known as a wideband switchable amplifier, which features very low switching noise.

I arrange for blanking immediately after sufficient time has elapsed, such that only targets within the desired range will be detected.

Most importantly to this invention, I achieve range control such that the warhead will be activated on specified small, low reflectivity targets when the target is within lethal range of the warhead, yet not operate when objects of high reflectivity are present at distances beyond lethal range.

In contrast with E/O optical devices whose range is a function of system response, my invention makes possible the relaxation of optical specifications and optical alignment, with less dependency on emitter power, while at the same time improving sensitivity and making programmable range cut-off readily possible.

In contrast with other range-gated fuzes, my device is inherently simpler and of lower cost, because of fewer electronic parts and because E/O alignment is less critical. Also, my device is less vulnerable to jamming, due to a much shorter receive window period. Furthermore, and E/O fuze with range gating effectively controls the target detection pattern. Compared to RF fuzes, E/O emission and reception is easy to confine to a desired pattern.

It is therefore a principal object of my invention to provide an optical, range gated proximity fuze of minimal cost, which prevents weapon ineffectivity due to the detection of targets that are outside lethal range of the warhead.

It is another important object of my invention to provide a low cost optical, range gated proximity fuze that eliminates warhead detonation at the wrong time or place, by selectively blanking the receiver, thus preventing detection of objects beyond the effective range of the warhead.

Yet another object of my invention is to provide a novel fuze usable in single channel or multichannel form.

Yet still another object of my invention to provide a system that is difficult to jam inasmuch as it is sensitive only during the gated interval.

Jamming is normally accomplished by the jammer changing the fuze's gain, or by simulating a target. Since the triggering rate of the laser utilized in accordance with this invention will be random in order that any efforts by a constant rate jamming device will be defeated, the possibility of a jammer injecting a target at the precisely correct time becomes quite remote. This is additionally true inasmuch as the narrow viewing angle of the lens I prefer to use would require a very precise angle of entry of pulses of a very high intensity, and furthermore, AGC time constants I utilize are such as to additionally serve to help prevent jamming as well as to reduce sensitivity due to influence of the sun.

Advantageously in the use of my invention, the maximum range can be changed or selected in flight, with range selection being possible at any time up to detection of an in-range target.

Also, it is possible to have different maximum ranges for each channel of a multichannel system, in order to compensate for evasiveness of certain selected targets.

DETAILED DESCRIPTION

Figure 1:
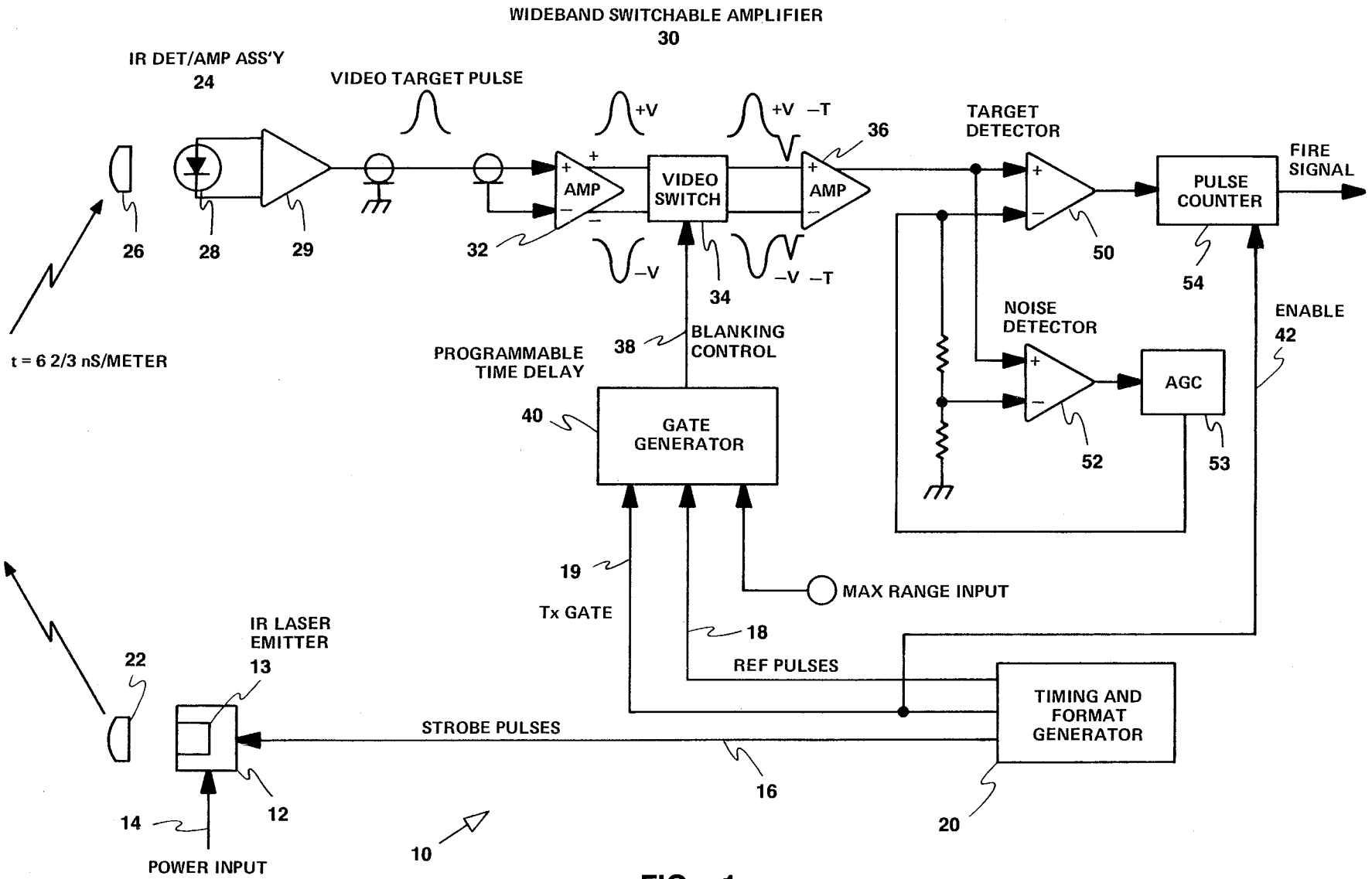
FIG. 1 is a block diagram of a single channel embodiment of my novel optical range gated fuze system.

In FIG. 1, I reveal in somewhat simplified form, an operative fuze system 10 in which a power and drive unit 12 supplies power to a transmitter means that principally includes an IR laser emitter 13. Power may be obtained from a suitable source 14, such as from a battery residing in a different part of the missile from the fuze section. Strobe pulses are supplied to the laser emitter over lead 16 extending from the timing and format generator 20 to the unit 12. The emitter assembly 13 has a fast rise time, and preferably utilizes a solid state laser diode. The laser optical output takes place through a lens 22 directed toward the target.

Laser energy is reflected from the target and received by an IR detector/amplifier assembly 24, also known as a receiver means. A lens 26 is preferably utilized in conjunction with the assembly 24, so as to focus the incoming pulses upon the laser detector 28, which may be a high speed photo diode. The optical system shown in this figure uses lenses 22 and 26 that are each preferably wide field of view devices, and quite importantly, the lenses are coaligned so that the transmitter and the receiver view the same volume.

Continuing with the receiver 24, the output of the laser detector 28 is amplified by preamplifier 29, the gain of which, in the interests of simplicity, may be fixed.

The output of preamplifier 29 is connected to the wideband switchable amplifier 30, which is made up of amplifier 32, video switch 34, and amplifier 36. The switchable amplifier 30 may also be referred to as a blanked wideband video amplifier. The video switch 34 is connected by a lead 38 to a gate generator 40 having a programmable time delay. Importantly, the gate generator 40 receives timed reference pulses on lead 18 from the timing & format generator 20, and receives the transmitter gate Tx on lead 19 extending from the same source.

The timing & format generator 20 may be constructed of $T^2L$ logic or CMOS logic, that serves to generate gating and timing for the system. It utilizes a clock, countdown circuits, and other components such that it can generate recurring noise modulated reference pulses for the receiver section, that correspond in PRF to the strobe pulses on line 16 to the power and drive unit 12 that drives the laser transmitter 13.

Maximum range may be set just prior to launch, and then maintained in logic registers, or range can be set via a telemeter link while the missile is in flight. The fuze is enabled a certain time period after launch, and after that, detonation is determined by the fuze when during flight it comes close enough to the target.

It will be seen hereinafter in FIG. 3 that clock pulses occurring on lead 18 are the reference pulses for the system. These reference pulses preferably occur at a random rate to counter jamming attempts.

In accordance with this invention, the video switch 34 passes pulses representative of a target within the lethality range of the associated warhead, but it inhibits the passage of pulses representative of targets outside such lethality range. This important aspect of my invention will be discussed at greater length hereinafter.

The pulses due to target reflections pass through the video switch 34 in a differential manner driven by amplifier 32 and are recombined differentially by amplifier 36. The switching transients due to the switch 34 are cancelled by differential amplifier 36, and then are detected by the signal detector 50. This, also, will be discussed hereinafter.

As shown in FIG. 1, the target detector (signal detector) 50 is used in combination with an AGC controller made up of noise detector 52 and AGC circuit 53. The noise detector 52 is utilized with the signal detector 50 to set the threshold level of the signal detector 50. The gain is automatically set to an appropriate level based on the amplitude of the background noise, and the length of the sampling period.

Since in accordance with a preferred arrangement of this invention, the noise level is maintained below the target detection level by the resistor network, this insures that a minimum amplitude target will be sensed. By the use of the noise detector 52 to set gain, the system can have a known, preestablished sensitivity, and it can compensate for an expected variation in background intensity, such as due to a change from day to night, and can also compensate for changes in component values over the life of the system.

The output from the target detector is combined with the outputs from other channels in the event a multichannel system is used. The proper combining of the channels is accomplished by the use of an OR gate, as will be discussed hereinafter in connection with FIG. 6, the output from which gate being provided to a counter 54.

Continuing with FIG. 1, the pulse counter 54 appearing in this figure receives a logic "1" from the signal detector 50 for each pulse detected by the foregoing circuit. The pulse counter is enabled by a gate provided on lead 42 from the timing & format generator 20. The pulse counter must receive a selected number of contiguous logic 1's in order to validate a target. When this test passes, a "fire" signal is outputted from the fuze section, which is sent to the warhead via the guidance section of the missile, which verifies that the missile continues to be active. The warhead then detonates. Thus, the random detection of a pulse from a jammer is effectively prevented from triggering the system.

Figure 2:
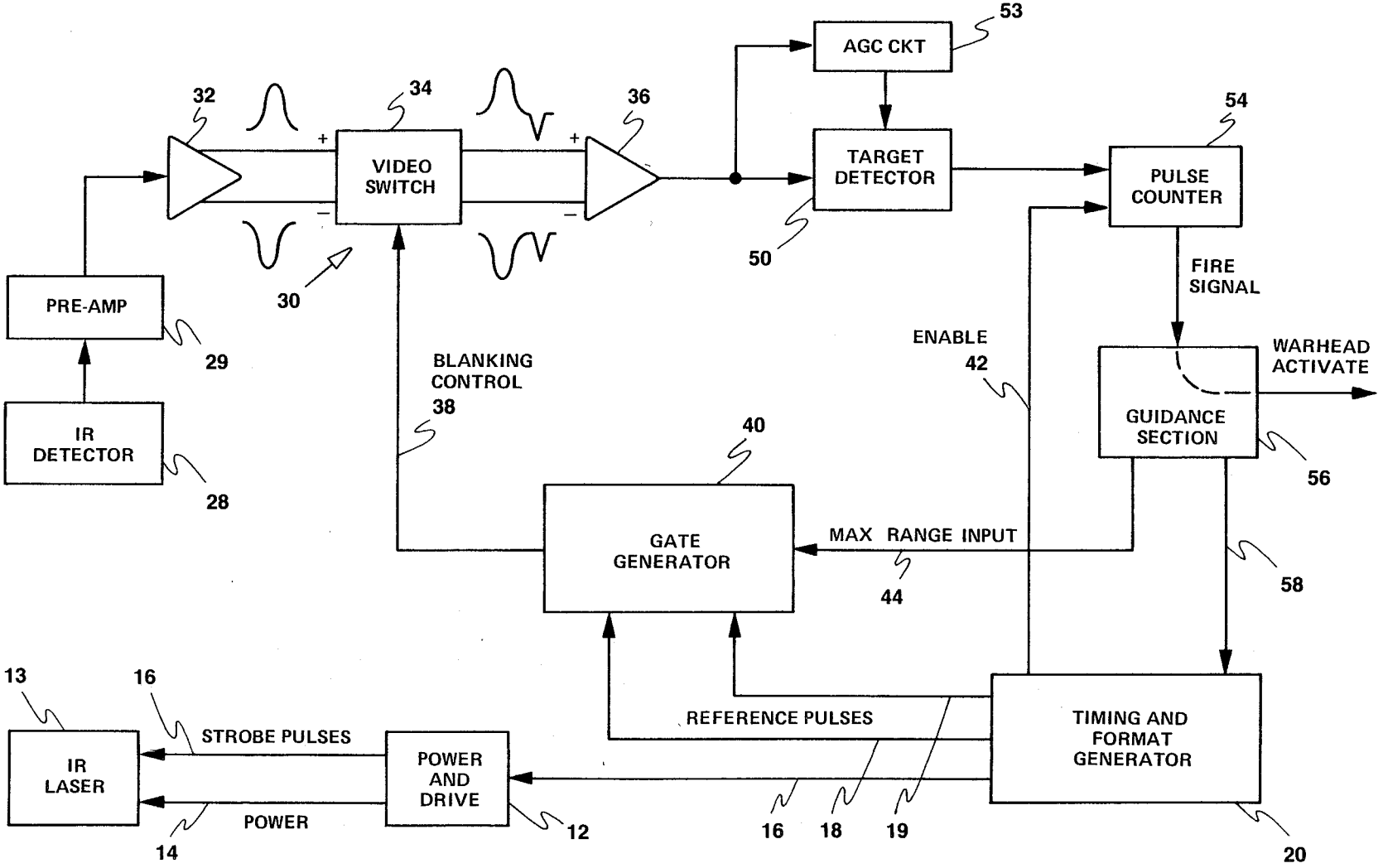
FIG. 2 is a block diagram similar to FIG. 1, except that certain circuit details are omitted, and the relationship of my fuze system to the guidance section of the associated missile is indicated.

In FIG. 2 I have provided a block diagram of my fuze, prepared with regard to the system standpoint.

The IR laser 13 is a high power solid state laser diode, and I may prefer to use a stacked array of laser diodes where long range operation is desired. The laser is here shown being supplied with power and strobe pulses over leads 14 and 16 from the power and drive unit 12. Certain important details will be more apparent in connection with FIG. 3.

Continuing with FIG. 2, the timing & format generator 20 generates strobe pulses on lead 16 for the laser transmitter, whose time occurence is randomized by means of noise modulation. As previously explained, it also supplies synchronized reference pulses on lead 18 to the gate generator, which is a programmable means to change the gate generator stop and start times. The gate generator also receives $T_x$ gate pulses over lead 19 from the timing & format generator. The receiver gate will pass the receiver output to the signal detector only after the laser is fired, and only for a controlled period. Importantly, the gate is open only for a pre-established period to accept targets that are within the maximum system range. Detonation will occur when the target is within the specified volume of lethality of the associated warhead.

Thus it is to be seen that the gate generator 40 is part of a blanking control in accordance with this invention, for preventing objects out of the range of lethality of the warhead from activating the fuse.

The IR detector 28 is arranged to receive the energy reflected from the target, and it is preferably a solid state photo diode capable of responding to 50 ns laser pulses. The preamplifier 29 is arranged to receive the output of the IR detector 28, which is measured in microvolts, and to bring the pulse amplitude up to approximately 5 millivolts so that the target return will be significantly larger than the detected noise on its path to the video switch 34. The preamplifier 29 is a low noise, wide band amplifier placed close to the detector, and for example may be a cascade low noise amplifier to minimize noise and achieve the best system sensitivity.

The output from preamplifier 29 is fed to the wide-band switchable amplifier 30, and more particularly to the first differential amplifier 32, which generates positive and negative video. (For convenience, I refer to the combined target returns and receiver noise as it appears at the input to amplifier 32 as being "video"). This dual polarity video is fed to video switch 34, which utilizes parallel blanking switches, which either pass or blank the video signals. The blanking switches generate some degree of transients when they switch, which is very undesirable. These transients are of the same phase, while the video is of opposite phase. Advantageously, when the composite of the video and the transients are combined in the second video amplifier 36, the transients are cancelled by the common mode feature of differential amplification. Only the video from the target is amplified and fed on to the signal detector stage of the noise AGC. Thus, transients signal problems are satisfactorily overcome in a novel and highly advantageous manner.

Figure 4A:
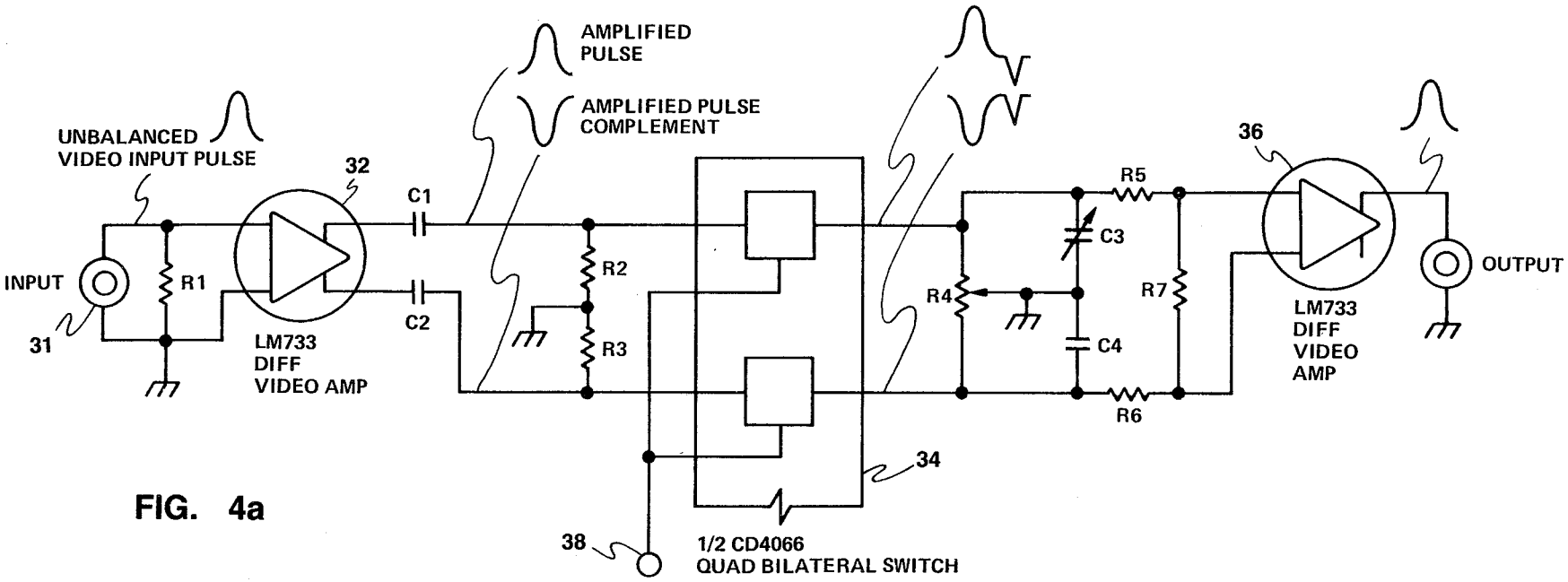
FIG. 4*a* is a showing of one embodiment of my novel wideband switchable amplifier, also known as a blanked wideband video amplifier.
Figure 4B:
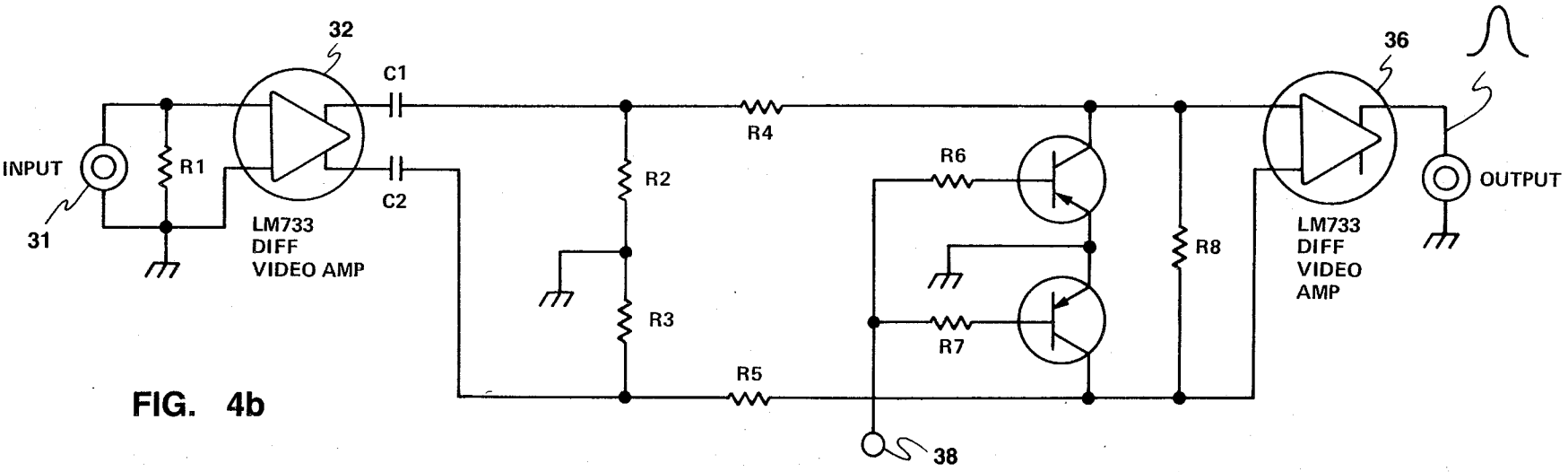
FIG. 4*b* is a preferred embodiment of my novel wideband switchable amplifier, utilizing parallel blanking switches employing transistors.

The video switch 34, particular embodiments of which are shown in greater detail in FIGS. 4*a* and 4*b*, is typically a high frequency analog gate made up of either bipolar transistors or CMOS FETS in a series or a shunt configuration in order to eliminate video from passing through to the following amplifier. The preferred video switch configurations serve to eliminate any gate noise or ringing on the video by utilizing the differential arrangement explained above.

It is to be noted that appropriate placement of the video switch 34 is important. By being placed before the gain control, it prevents false targets from bringing about a change in the AGC setting, and thus causing upset to the system. Also, it serves to protect against potential jammers by looking at the IR detector output only during periods of interest.

As previously indicated, the output from the video switch 34 is directed to amplifier 36, with the output of this amplifier being connected to Target Detector 50. The amplitude of the pulses and the noise level during the selected period is analyzed in order to set the detect threshold by changing the detection level of the detector 50. The latter is accomplished by utilizing the AGC feedback 53 to the detector 50, as was also indicated in FIG. 1.

The target detector 50 serves as a means to convert the video pulses into a digital form suitable for driving the pulse counter 54. An output pulse from detector 50 will be generated when the signal out of amplifier 36 reaches a level set by AGC circuit 53. It is to be noted that the target detector and pulse counter stages have internal time constants, and operate independently of range selected.

The pulse counter 54 tests for a valid number of contiguous return pulses, and generates a "fire" signal if this test passes, which signal is delivered to the guidance section 56. The output from the guidance section is the warhead activate signal.

The lead 58 provides the fuze enable control signal from guidance section 56 to the timing and format generator 20, and provides range to target presets thereto. A range to target control signal may be loaded into the fuze system just prior to launch, via the guidance section 56, which contains the central processor for the missile. Advantageously, the range signal can be changed while in flight if the guidance section sends a new command, and range can be selected anytime up to the detection of an in-range target. If a range signal is not sent, the fuze will detonate at maximum lethal range. Shorter ranges are needed near the ground. A crush fuze is utilized in order to cover the situation when a direct hit is involved.

It is to be noted that although only single components have for convenience been illustrated in this exemplary embodiment, more than one component may in fact be used. For example, I can use four IR lasers, IR detectors, preamps, and switching amplifiers to enable a full circle to be established in a properly spaced manner around the missile, as will be discussed in connection with later figures herein. Any number of channels could be used, but four is the most common in side-looking E/O fuzes. In contrast, a rf fuze may need only one channel, whereas a hard to detect E/O fuze could have eight or more channels.

Figure 3:
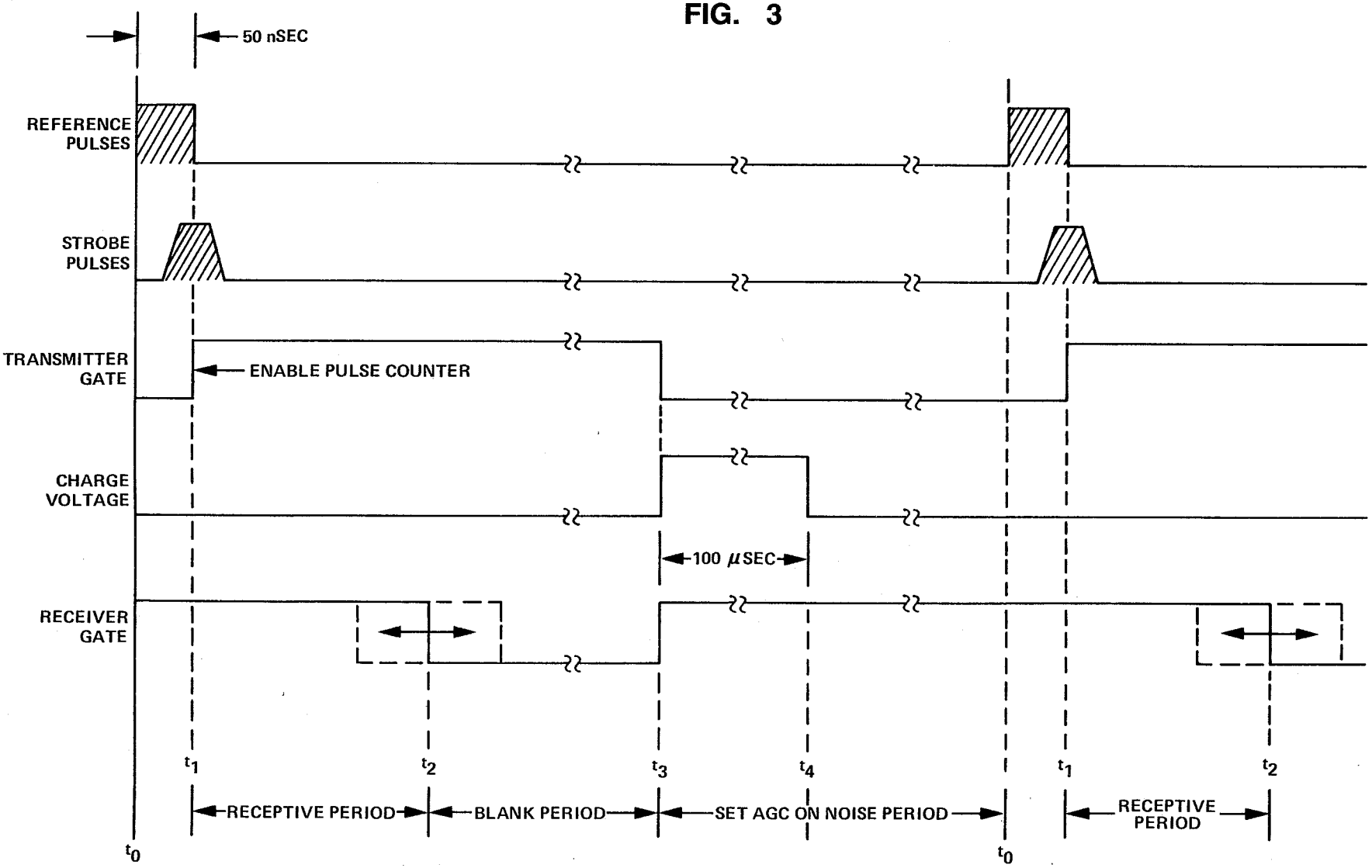
FIG. 3 is a timing diagram of my fuze system, showing the recurring reference pulses responsible for starting the sequence of events, and their relationship to other events.

Turning now to FIG. 3, it will there be seen that I have provided waveforms relating to the significant control signals of my novel fuze.

In the first line of FIG. 3 are shown typical pulses representing the master clock of my fuze system. Each reference pulse causes a laser strobe pulse, bringing about the firing of the laser 13. The reference pulses are shown to occur in each instance at $t_0$, although it is to be understood that these and other pulses may be randomly modulated to counter jamming efforts.

In the second line of FIG. 3 are depicted the strobe pulses, which are applied to the laser emitter 13. The laser fires when this pulse reaches approximately 50% of maximum.

In the third line of FIG. 3, it will be seen that I have depicted the transmitter gate waveform applied at $t_1$ to line 42 of FIGS. 1 and 2, to enable the pulse counter 54 during the period $t_1$ to $t_3$. This enabling takes place over approximately one microsecond after the laser is fired, although this time period is generally not critical.

In the fourth line of FIG. 3, it will be seen that I have depicted by the waveform extending from $t_3$ to $t_4$, the charging of the laser power supply, which may take place for a duration of 100 microseconds. This charging takes place during the out-of-range period, to avoid self EMI.

In the fifth line of FIG. 3 I have depicted the waveform appearing on line 38 of FIGS. 1 and 2, with its adjustable edge $t_2$ representing the disabling of the receiver for a prescribed period after the laser is fired, with the receiver being in the unblanked or receptive period only long enough to permit targets in range to be detected. The AGC is set during the period from $t_3$ to $t_0$.

Turning to FIG. 4*a*, I there show a block diagram of one embodiment of my novel Wideband Switchable Amplifier 30, which features very low switching transients even when switching rates fall within the desired video bandwidth.

The unbalanced video pulse is received at input terminal 31, and is then applied to a differential video amplifier, such as an LM 733. Positive and negative video are generated, as depicted near the output leads of this amplifier. This dual phase video is fed to series gates, which may be referred to as parallel blanking switches, these serving to make up the video switch 34. The blanking switches either pass or blank the video signals, in response to blanking control provided on lead 38. As shown in this figure, I may use one-half of a CD 4066 quad bilateral switch in this arrangement.

The blanking switches generate some degree of transients when they switch, which is quite undesirable. These transients are of the same phase, whereas the video is of opposite phase, and when combined in the second differential amplifier 36, the transients are cancelled by the common mode feature of differential amplification. Therefore, only the video from the target is amplified and then fed to the signal detector stage of the noise AGC.

It should be noted that the waveforms representing the outputs from the blanking switches of video switch 34 reveal an amplified pulse (and pulse complement) plus switch noise, with the signal to noise ratio being approximately 6 db, whereas the amplified pulse depicted adjacent the output of the differential video amplifier 36 represents a pulse with greatly attenuated switch noise, with the signal to noise ratio being found to be approximately 30 db.

It was found advantageous in some instances in eliminating the switching noise in the embodiment of FIG. 4*a*, to have a balance adjustment made conveniently possible by utilizing potentiometer $R_4$ at the output of the switches. This forms a DC balance at the input to the differential amplifier 36. To further balance the AC component of the video, capacitors $C_3$ and $C_4$ were added, with $C_3$ being adjustable so that a near perfect balance of signals at the input to the differential amplifier 36 can be obtained.

A preferred embodiment of my Wideband Switchable Amplifier is shown in FIG. 4*b*. As in the previous embodiment, the unbalanced video pulse is received at input terminal 31, and is then applied to a differential video amplifier 32, such as an LM 733. Positive and negative video are generated, with this dual phase video being fed to shunt gates, which may be referred to as parallel blanking switches. These serve to shunt video to ground during the period of blanking. When the switches are conductive, the video is shunted to ground and blanked, whereas when the switches are non-conductive, the video passes over the switches to the next stage. I may use transistors 2N 2484 as these switches in the preferred arrangement.

It is to be noted that shunt switches using transistors 2N 2484 are much faster in cut-off than the quad bilateral switch described in the preceding embodiment illustrated in FIG. 4*a*, and inasmuch as this is responsible for better resolution, the transistorized version of my switch is preferred.

The transistors used as blanking switches generate some degree of transients when they switch, which is quite undesirable. These transients are of the same polarity, whereas the video is of opposite phase, and when combined in the second differential amplifier 36, the transients are cancelled by the common mode feature of differential amplification. Therefore, only the video from the target is amplified and then fed to the signal detector stage of the noise AGC.

The foregoing wideband switchable amplifier represents a key solution to the problem of designing a non-complex range gated fuze, and is one of the novel aspects of my novel combination.

When multiple sensors are to be used in a non-spinning missile, the system could be reconfigured to utilize four lasers, four receivers, and four sets of electronics utilized in conjunction with a single OR gate and single pulse counter. The AGCs are not used in common, inasmuch as the entry of sunlight would likely desensitize all four channels instead of only one.

Figure 5B:
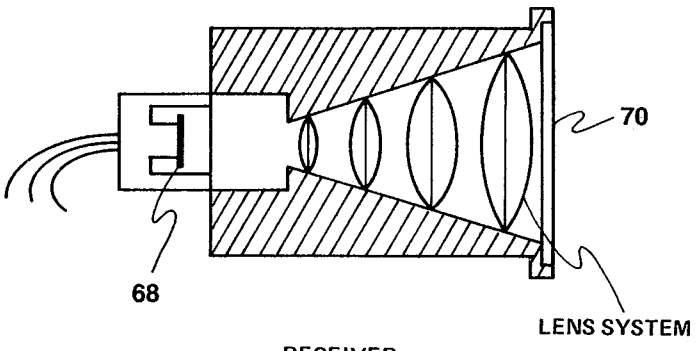
FIGS. 5*a* and 5*b* depict typical transmitter and receiver components, and in FIG. 5*c* I reveal a typical arrangement of a plurality of these components utilized on a missile.
Figure 5A:
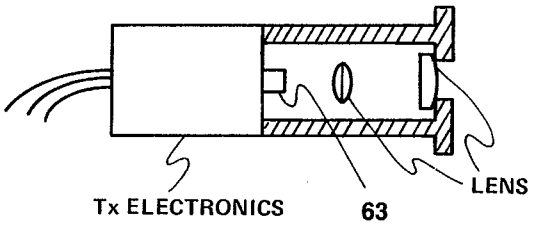
Figure 5C:
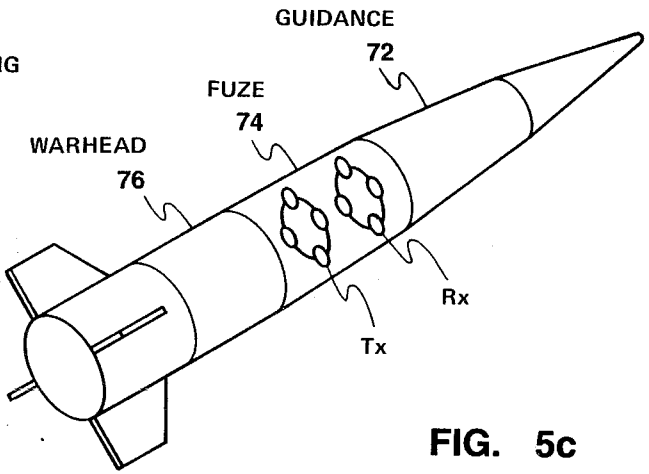
FIG. 5 is an idealized front view of a missile equipped with four optical radars, the range of which is electrically limited in accordance with this invention to a range R.
Figure 5:
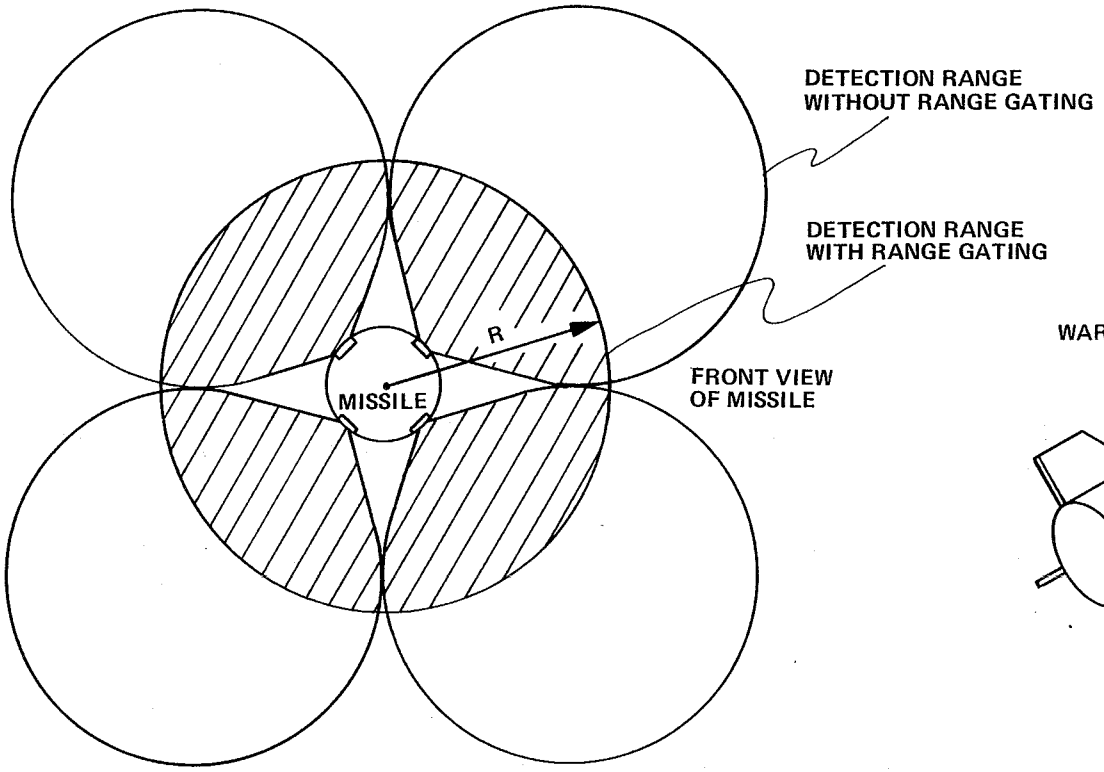

FIG. 5 illustrates the basic operation of an optical fuze in accordance with this invention when four optical transmitters and receivers cover the perimeter of the missile. This figure represents the front view of a missile with projected side lobes. If a target is sensed within the range R from the missile, it will activate the fuze after suitable countermeasure precautions. The four lobes in their entirety illustrate the potential detection range of the optical radar if certain electrical provisions were not employed in accordance with this invention to limit the range to a designated range R.

In FIG. 5*a*, I show a typical example of exemplary transmitter electronics, involving a portion of an emitter assembly, utilizing a laser diode 63 disposed behind an aligned pair of lenses. In FIG. 5*b*, I reveal a typical receiver component, wherein a lens system is arranged to direct incoming radiation at a semiconductor target, such as a photocell 68 in the preferred instance. I prefer for several reasons to use an IR filter 70 adjacent the first lens component, with one important reason being the desire to improve the signal to noise ratio on targets which are illuminated by sunlight.

In FIG. 5*c*, I illustrate to a very small scale, how certain components of my invention may be deployed upon a missile. As to be seen, the fuze section 74 is located aft of the guidance section 72, and I typically dispose four transmitter components at equal intervals around a forward portion of the fuze section of the missile, with four receiver units disposed at equal intervals around the rear portion of the fuze section. The warhead 76 may be located behind the fuze section.

Figure 6:
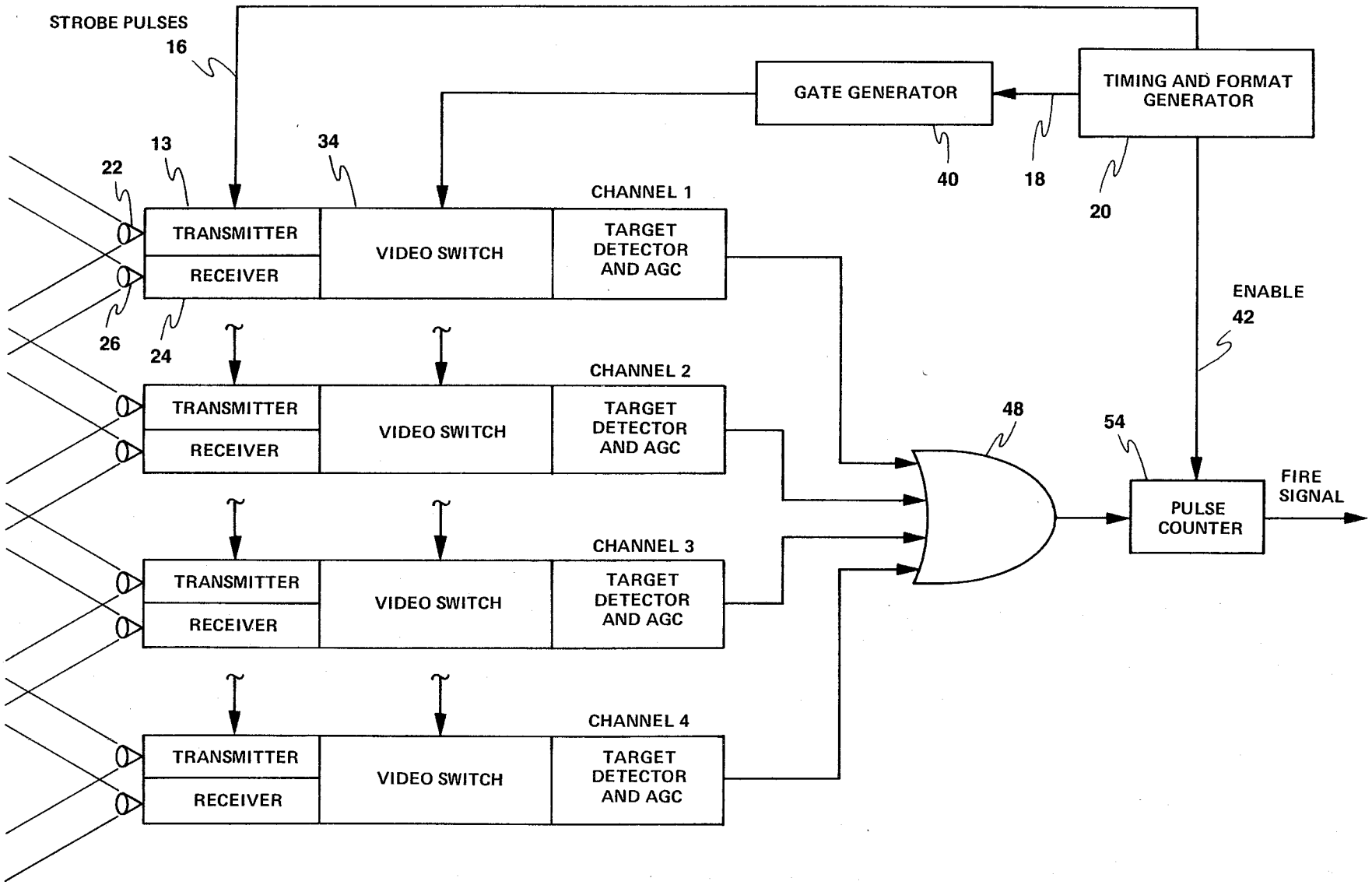
FIG. 6 is an implementation of a four channel fuze system wherein the target returns are combined to drive one pulse counter.

The electronic arrangement for the four fuzes of the embodiment of FIG. 5 is depicted in block diagram form in FIG. 6. As will be noted, I here utilize four separate, parallel channels, each complete with optical receiver and transmitter, range gating arrangement, target detector, and AGC. As will be noted, the outputs of the four channels are summed in an OR gate, which drives a single pulse counter 54. The counts are accumulated from all channels in the counter.

The counter 54 is reset periodically, as previously discussed, and also as a result of becoming aware of missing pulses.

The gate generator 40 sensitizes the system so that it will sense the target within the selected range R, as depicted in FIG. 5. When the pulse counter 54 has accumulated a desired number of pulses, it will activate the warhead. Preferably I utilize an arrangement such that random pulses will be eliminated from the counter unless a consecutive group of target returns are sensed.

A range gated proximity fuze system in accordance with this invention may, as shown in FIG. 6, utilize a plurality of channels employing a common timing means 20 and a common gate generator 40. Each of the four channels utilizes emitter (transmitter) means as well as detector (receiver) means, with the timing means 20 providing reference pulses to the gate generator on lead 18, as well as providing strobe pulses on lead 16 to the emitter means of channels 1 through 4. These strobe pulses bear a relationship to the reference pulses, as previously made clear, with the strobe pulses causing energy to be transmitted by the respective transmitters toward a potential target.

The detectors are disposed to receive energy reflected back from the target, and being connected to direct such energy through amplification means to the respective video switches 34. Each of the video switches is arranged to drive its respective target detector and AGC circuit, with the outputs of the multiple target detectors being combined by OR gate 48, and driving the common pulse counter 54.

The video switch of each channel is placed to control the flow of such received energy to its target detector, with each of the video switches being connected to gate generator 40 so that blanking pulses supplied by the gate generator in timed relation to the reference pulses and strobe pulses can be utilized to control the flow of energy through the respective video switch. Each video switch thus serves as a result of the receipt of such blanking pulses to prevent energy representative of targets beyond a certain range from passing to the pulse counter, thereby preventing the pulse counter from providing a fire signal to the associated warhead except when the detected target is within lethal range of the warhead.

I claim:

1. A proximity fuze of adjustable maximum range, configured to detect target pulses reflected only from a target within the lethality range of the associated warhead, comprising a wideband switchable video amplifier connected to receive pulse inputs from a receiving means, a blanking control means, and a pulse counter, said video amplifier serving to supply an amplified version of said inputs to said pulse counter, said video amplifier also being connected to receive signals from said blanking control means, which signals from latter means do not interfere with the passage through said video amplifier of pulses representative of a target that will fall within the lethality range of the associated warhead, said video amplifier, however, receiving blanking signals from said blanking control means that serve to prevent pulses reflected from a target outside such lethality range from reaching said pulse counter, such that the warhead will not be detonated in latter instance.

2. The range gated fuze system as defined in claim 1 in which said video amplifier incorporates blanking switches utilizing a quad bilateral switch.

3. The range gated fuze system as recited in claim 1 in which said video amplifier utilizes parallel blanking switches utilizing transistors.

4. A proximity fuze of adjustable maximum range, configured to detonate an associated warhead only when targets within the lethality range of the warhead have been detected, comprising receiver means, a video switch, and a pulse counter, said receiver means being positioned to receive target pulses reflected from a target, and to supply therefrom an amplified version of said pulses to said video switch, said video switch being connected to supply energy representative of a detected target to said pulse counter, and also being connected to receive blanking signals from a programmable time delay means, said time delay means providing no signals interferring with the passage through said video switch of pulses representative of a target within the lethality range of the associated warhead, but providing blanking signals that serve to prevent pulses reflected from a target outside such lethality range from passing through said video switch to said pulse counter.

5. The proximity fuze as recited in claim 4 wherein said fuze is configured and constructed to be used in a radar system.

6. The proximity fuze as recited in claim 4 wherein said fuze is configured and constructed to be used in an electro-optical system.

7. The proximity fuze as recited in claim 4 wherein said fuze is used with emitter means operating at random rate to prevent jamming.

8. The range gated fuze system as defined in claim 4 in which the maximum range of said fuze can be set while the missile is in flight.

9. The range gated fuze system as defined in claim 4 in which said video switch incorporates blanking switches utilizing a quad bilateral switch.

10. The range gated fuze system as recited in claim 4 in which said video switch incorporates parallel blanking switches utilizing transistors.

11. A range gated proximity fuze system for a missile or the like equipped with a warhead, said fuze system comprising timing means, a gate generator, a detector, a video switch, and a pulse counter, said timing means providing reference pulses to said gate generator, said timing means also providing strobe pulses to an associated emitter, which strobe pulses bear a relationship to said reference pulses, said strobe pulses causing energy to be transmitted by the emitter toward a potential target, said detector being disposed to receive energy reflected back from the target, and being connected to direct such energy through amplification means to said video switch, such energy then flowing through said video switch to said pulse counter, said video switch serving to control the flow of such received energy to said pulse counter, said gate generator being connected to said video switch so that blanking pulses supplied by said gate generator in timed relation to said reference pulses and strobe pulses can be utilized to control the flow of received energy through said video switch, said video switch serving as a result of the receipt of such blanking pulses to prevent energy representative of targets beyond a certain range from passing to said pulse counter, thus to prevent said pulse counter from providing a fire signal to the associated warhead except when the detected target is within lethal range of the warhead.

12. The range gated fuze system as defined in claim 11 in which a plurality of such fuze systems are configured such that multiple detectors and emitters may be arrayed around a missile in order to afford total coverage.

13. The range gated fuze system as defined in claim 11 in which the maximum range of each channel can be independently programmed to compensate for evasive targets.

14. The range gated fuze system as defined in claim 11 in which the maximum range can be set while the missile is in flight.

15. The range gated fuze system as defined in claim 11 in which said video switch incorporates blanking switches utilizing a quad bilateral switch.

16. The range gated fuze system as recited in claim 11 in which said video switch incorporates parallel blanking switches utilizing transistors.

17. The range gated fuze system as recited in claim 11 wherein said timing means periodically serves to enable said pulse counter.

18. The range gated fuze system as recited in claim 11 wherein a target detector is interposed between said video switch and said pulse counter, said target detector being used in combination with an AGC controller serving to set the threshold level of said target detector at an appropriate level when considering the amplitude of the background noise, said timing means determining the intervals at which the threshold level is set.

19. A range gated proximity fuze system utilizing a plurality of channels and usable in a missile equipped with a warhead, comprising a common timing means, a common gate generator, and a common pulse counter, each of said channels utilizing emitter means, receiver means, video switch, as well as detector means, said timing means providing reference pulses to said gate generator, said timing means also providing strobe pulses to the emitter means of each of said channels, which strobe pulses bear a relationship to said reference pulses, said strobe pulses causing energy to be transmitted by each emitter means toward a potential target, said receiver means of each channel being disposed to receive energy reflected back from the target, and being connected to direct such energy through amplification means to the respective video switches, each of said video switches being arranged to pass received energy to its respective target detector and AGC circuit, the outputs of said multiple target detectors being combined by an OR gate, and driving a common pulse counter, said video switch of each channel thus being placed to control the flow of such received energy to its respective target detector, each of said video switches being connected to said gate generator so that pulses supplied by said gate generator in timed relation to said reference pulses and strobe pulses can be utilized to control the flow of energy through the respective video switches, each video switch serving as a result of the receipt of blanking pulses from said gate generator to prevent energy representative of targets beyond a certain range from passing to said pulse counter, thus to prevent said pulse counter from providing a fire signal to the associated warhead except when the detected target is within lethal range of the warhead.

20. The range gated fuze system as defined in claim 19 in which the maximum range can be set while the missile is in flight.

21. The range gated fuze system as defined in claim 19 in which said video switch incorporates blanking switches utilizing a quad bilateral switch.

22. The range gated fuze system as recited in claim 19 in which said video switch incorporates parallel blanking switches utilizing transistors.

* * * * *